US006336996B1

(12) United States Patent
Steiner

(10) Patent No.: US 6,336,996 B1
(45) Date of Patent: Jan. 8, 2002

(54) PROCESS AND DEVICE FOR THE TRANSFER OF A FIBROUS MATERIAL WEB

(75) Inventor: Karl Steiner, Herbrechtingen (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/286,296

(22) Filed: Apr. 6, 1999

(30) Foreign Application Priority Data

Apr. 9, 1998 (DE) ..... 198 15 994

(51) Int. Cl.[7] ..... D21F 1/36; D21F 11/00
(52) U.S. Cl. ..... 162/193; 162/204; 162/205
(58) Field of Search ..... 162/193, 306, 162/370, 368, 369, 371, 372, 204, 205, 286, 255, 194; 34/120, 116, 117

(56) References Cited

U.S. PATENT DOCUMENTS

| | | | | |
|---|---|---|---|---|
| 4,921,575 A | | 5/1990 | Page | |
| 5,281,308 A | | 1/1994 | Lauterbach | |
| 5,718,806 A | * | 2/1998 | Trokhan et al. | 162/363 |
| 5,762,759 A | | 6/1998 | Wedel | |

FOREIGN PATENT DOCUMENTS

| | | |
|---|---|---|
| DE | 1178691 | 10/1964 |
| DE | 1180237 | 10/1964 |
| DE | 1901450 | 6/1970 |
| DE | 4023297 | 1/1992 |
| DE | 19511988 | 8/1996 |
| DE | 19544882 | 6/1997 |
| WO | 9104372 | 4/1991 |
| WO | 93/21379 | 10/1993 |

* cited by examiner

*Primary Examiner*—Stanley S. Silverman
*Assistant Examiner*—Dionne A. Walls
(74) *Attorney, Agent, or Firm*—Greenblum & Bernstein, P.L.C.

(57) ABSTRACT

Process and device for transferring at least one of a fibrous material web and a strip of the fibrous material web from a moist releasing belt to an accepting belt in a web producing machine that includes a transfer region and a separating region arranged in this order in a web travel direction. The process includes guiding the accepting and releasing belts together at least in the transfer region, separating the accepting belt from the releasing belt in the separating region, and suctioning a surface of the accepting belt opposite a fibrous web and strip carrying surface so that the strip and the fibrous material web are carried by the carrying surface. When the strip is being transferred, the suctioning occurs at least the transfer region, and when an entire width of the fibrous material web is being transferred, the suctioning occurs at least primarily in die separating region. The device includes a transfer region, a separating region arranged downstream of the transfer region in a web travel direction, a releasing belt adapted to carry the strip and the fibrous material web to the transfer region, and an accepting belt adapted to receive the strip and the fibrous material web from the releasing belt in the transfer region. The device also includes at least one movable suction zone extending crosswise to the accepting belt and positioned so that the accepting belt is aided past the at least movable one suction zone. The at least one movable suction zone is positionable between the transfer region and the separating region.

21 Claims, 1 Drawing Sheet

PROCESS AND DEVICE FOR THE TRANSFER OF A FIBROUS MATERIAL WEB

CROSS-REFERENCE TO RELATED APPLICATIONS

The present application claims priority under 35 U.S.C. § 119 of German Patent Application No. 198 15 994.3, filed on Apr. 9, 1998, the disclosure of which is expressly incorporated by reference herein in its entirety.

BACKGROUND OF THE INVENTION

1. Field of the Invention

The present invention relates to a process and device for transferring a fibrous material web and/or a strip of the material web from a moist belt to an air-permeable belt. The belts travel together at least in a transfer region and separate after the transfer region. Suction is applied to a surface of the air-permeable belt that accepts or receives the web or strip of web that is opposite the fibrous material web carrying surface.

2. Discussion of Background Information

Processes and devices of the type generally discussed above are known for use in machines for manufacturing and/or refining fibrous material webs, e.g., paper, cardboard, or tissue webs.

When transporting moist fibrous material webs at high speed, e.g., in the press sections of drying sections of paper making machines, the fibrous material web is supported against at least one belt, e.g,. a press felt, press belt, drying wire, or the like. In this manner, the travel of the fibrous material web is stabilized, which counteracts a tearing of the web.

Transfer of the fibrous material web from a belt that is often moist to a belt positioned on the other side of the fibrous material web is disclosed, e.g., in EP 519 920, and is usually facilitated by suction zones. This is also true when the machine is started up, i.e., when an ever widening strip of the fibrous material web is threaded through the machine. Since a strip is easier to handle during threading, the introduction of the whole fibrous material web is consequently simplified.

However, in the known processes and devices, not only is the fibrous material web sucked against the accepting belt in the transfer regions but water from the releasing belt is sucked into the fibrous material web. As a result, an undesirable re-wetting of the fibrous material web occurs.

SUMMARY OF THE INVENTION

The present invention provides a process and device with which re-wetting of the fibrous material web can at least be reduced while providing a favorable web guidance.

According to the present invention, during the transfer of a strip of the fibrous material web, at least the transfer region is suctioned, and during the subsequent transfer of the entire fibrous material web, at least most of the separating region, which follows the transfer region in the web travel direction, is suctioned.

In this regard, the accepting belt may be guided or conveyed past at least one movable suction zone that extends crosswise (lateral) to the fibrous material web. The movable suction zone can be, e.g., pivoted between the transfer region and a separating region. The accepting belt may be guided or conveyed past at least one suction zone that extends crosswise to the fibrous material web and may be separately controlled in the transfer and separating regions. The accepting belt may be guided over at least one suction zone that extends laterally to the fibrous material web and the trace of the releasing belt can be changed to shift the position of the transfer region.

During the transfer of the strip of the fibrous material web, at least the transfer region is supplied with suction, and during the subsequent transfer of the entire fibrous material web, at least most of the separating region that follows the transfer region is supplied with suction, thus, the present invention provides for separate operating states. The insertion of the strip of the fibrous material web depends on a particularly distinct guidance of the strip since it runs a high risk of being torn. Therefore, the transfer region, and possibly also the separating region that follows it should be supplied with suction. This encourages the contact and adherence of the strip of the fibrous material web to the accepting belt in the transfer region and facilitates separation from the releasing belt in the separating region. Moreover, because the strip will be discarded once the threading is completed, re-wetting of the strip that occurs is deliberately accepted.

After the entire fibrous material web is traveling through the transfer region, a switch can be made into the normal operating state. As noted above, at this point, at least most of the separating region is supplied with suction. Since the entire fibrous material web has a greater stability, suction in the transfer region can be sharply reduced or even stopped. This not only saves energy, but also reduces re-wetting of the fibrous material web by not drawing moisture from the releasing belt into the web in the transfer region. The suction of the accepting belt in the separating region, i.e., at a point at which the releasing belt is no longer in contact with the fibrous material web is sufficient for providing good web guidance.

In order to be able to even more strongly counteract the re-wetting in the transfer region when the entire fibrous material web is being transferred, the accepting belt is blown, preferably with air on the surface remote from the fibrous material web However, the pressure of the blowing should be of only relatively low intensity.

In order to ensure as rapid as possible an adhesion of the fibrous material web or of the strip of the web onto the accepting belt, it may be advantageous, particularly in belts that are first brought together in the transfer region, to provide suction on the accepting belt immediately before the transfer region. In this manner,the air that is drawn into the inlet gap between the element with the suction zone and the accepting belt may be aspirated away.

The device in accordance with the present invention includes at least one movable suction zone extending crosswise (lateral) to the fibrous material web and over its width. The accepting belt is conveyed past the device. The movable suction zone can be moved, and preferably pivoted, between the transfer region and the separating region. In this manner, the location of the suction zone can be adapted to the respective operating state in accordance with the above-described process.

In another exemplary embodiment, the device may include at least two separately controllable suction zones that extend crosswise to the fibrous material web. In this instance, both the transfer region and the separating region may be respectively associated with one of the separately controllable suction zones. The control of the suction zones may be provided such that the suction zone associated with the transfer region is active when the strip of the web material is being transferred, and that the suction zone associated with the separating region is active when the entire width of the material web is being transferred.

In accordance with another exemplary embodiment of the present invention, the accepting belt may be guided over at least one suction zone that extends crosswise to the fibrous material web and the travel direction of the releasing belt may be changed so that a position of the transfer region changes. In this manner, the transfer region may be moved into the region of the suction zone or before it in the web travel direction, depending on the operating state.

In order to aspirate away the air entrained or carried along by the accepting belt, another suction zone, which extends crosswise to the fibrous material web, may be provided before the suction zone of the transfer region relative to the web travel direction. Further, the suction zone of the transfer region may be coupled to a compressed air source. Further still, since it is only intended to encourage the transfer a strip of this fibrous material web, the suction zone of the transfer region need not extend over the entire width of the fibrous material web.

A rotatable suction roll with a perforated roll jacket, as is described in, e.g., DE-OS 40 23 297, may be advantageously suited as a device for accommodating the suction zones, and this disclosure of this document is expressly incorporated by reference herein in its entirety. The position of the suction zones can be variably formed.

In another exemplary embodiment, the accepting belt may be guided directly over the suction zones and a sealing at the edges may be provided by sliding surfaces.

The present invention is also directed to a process for transferring at least one of a fibrous material web and a strip of the fibrous material web from a moist releasing belt to an accepting belt in a web producing machine that includes a transfer region and a separating region arranged in this order in a web travel direction. The process includes guiding the accepting and releasing belts together at least in the transfer region, separating the accepting belt from the releasing belt in the separating region, and suctioning a surface of the accepting belt opposite a fibrous web and strip carrying surface so that the strip and the fibrous material web are carried by the carrying surface. When the strip is being transferred, the suctioning occurs in at least the transfer region, and when an entire width of the fibrous material web is being transferred, the suctioning occurs at least primarily in the separating region.

According to another feature of the present invention, when the releasing and accepting belts are first brought together in the transfer region, the process further includes suctioning the accepting belt immediately before the transfer region.

According to still another feature of the present invention, when the entire width of the fibrous material web is being transferred in the transfer region, the process further includes blowing air on the surface opposite the carrying surface.

In accordance with a further feature of the present invention, the accepting belt is composed of an air permeable belt.

In accordance with a still further feature of the present invention, the process first transfers the strip and subsequently transfers the entire width of the fibrous material web.

The present invention is also directed to a device for transferring at least one of a fibrous material web and a strip of the fibrous material web from a moist releasing belt to an accepting belt in a web producing machine. The device includes a transfer region, a separating region arranged downstream of the transfer region in a web travel direction, a releasing belt adapted to carry the strip and the fibrous material web to the transfer region, and an accepting belt adapted to receive the strip and the fibrous material web from the releasing belt in the transfer region. The device also includes at least one movable suction zone extending crosswise to the accepting belt and positioned so that the accepting belt is guided past the at least movable one suction zone. The at least one movable suction zone is positionable between the transfer region and the separating region.

In accordance with another feature of the present invention, the at least one movable suction zone may be composed of separately controlled suction devices that extend crosswise to the accepting belt.

In accordance with still another feature of the present invention, a positionally movable guide roll may be arranged to deflect the releasing belt, thereby separating the releasing belt from the accepting belt in the separating region. In a first position, the movable guide roll guides the accepting belt and the releasing belt together past the at least one suction zone, and, in a second position, the movable guide roll guides separate the releasing belt from the accepting belt at a beginning of the at least one suction zone.

According to a flier feature of the present invention, the at least one suction zone may include a first suction zone that extends crosswise to the accepting belt and that is positioned upstream from the transfer region in the web travel direction.

According to a still further feature of the present invention, the at least one suction zone may be adapted to be supplied with compressed air in the transfer region.

In accordance with still another feature of the present invention, a rotating suction roll with a perforated jacket may be provided. The at least one suction zone may be located within the rotating suction roll.

In accordance with yet another feature of the present invention, sliding surfaces are arranged on upstream and downstream edges of the at least one suction zone, whereby the edges are sealed.

The present invention is also directed to a process for threading a material web through a web producing machine. The material web includes a threading strip that increases in width crosswise to the material web from a thin strip to an entire width of the material web. The process includes guiding the strip of the material web on a releasing belt toward a transfer region, guiding an accepting belt through the transfer region with the strip and the releasing belt, and suctioning the strip toward the accepting belt in the transfer region, whereby the strip is transferred onto the accepting belt. The process also includes separating the releasing belt from the accepting belt in a separating region located downstream of the transfer region in a web run direction, guiding the strip until the entire width of the material web is transferred to the accepting belt, and suctioning the entire width of the material web toward the accepting belt in the separating region.

According to another feature of the present invention, when the entire width of the material web is transferred to the accepting belt, the process may further include discontinuing suctioning in the transfer region In accordance with still another feature of the present invention, when the entire width of the material web is transferred to the accepting belt, the process may further include discontinuing suctioning in the transfer region, and blowing air through the accepting belt toward the entire width of the material web.

According to a further feature of the present invention, when the entire width of the material web is transferred to the accepting belt, the process may further include pivoting a suction device from the transfer region to the separating region.

In accordance with a still further feature of the present invention, the releasing belt may be deflected around a positionally movable deflection roll arranged downstream of the transfer region in the web run direction, and the process may further include positioning the deflection roll so that when the strip is being transferred to the accepting belt. Both the accepting belt and the releasing belt are guided past a suction device, and moving the deflection roll when the entire width of the material web is being transferred to the accepting belt so that the accepting belt is guided over at least most of the suction device without the releasing belt.

In accordance with another feature of the present invention, a suction device may be provided that is composed of a plurality of suction element successively arranged in the web run direction. The process may further include guiding the accepting belt over a first suction clement in the web run direction whereby entrained air is sectioned, guiding the accepting belt and the releasing belt over a second suction element in the web run direction which forms the transfer region, and guiding the accepting belt over at least most of a third suction element in the web run direction without the releasing belt, which forms the separating region.

According to still another feature of the present invention, the process may include suctioning the accepting belt prior to the transfer region in the web run direction.

According to yet another feature of the present invention, when the strip is being transferred to the accepting belt, no suctioning occurs in the separating region.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1A:
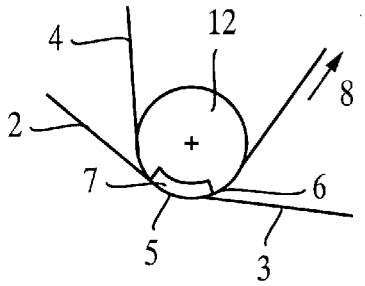
FIGS. 1A and 1B illustrate a suction roll with a suction zone.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In each of the exemplary embodiments, a fibrous material web 1 or a strip 2 of fibrous material web 1 is transferred from a moist releasing belt 3 to an air permeable accepting belt 4. Belts 3 and 4 may be arranged to travel together, at least in a transfer region 5, and may separate after transfer region 5. Air-permeable accepting belt 4 may be provided with suction on the surface remote from or opposite a carrying surface for fibrous material web 1 or strip 2.

The transfer in accordance with the features of the present invention may be performed in, e.g., the former part, the drying section, the press section, or between them. Further, belts 3 and 4 may be air-permeable and be formed by, e.g., felts or wires. Alternatively, releasing belt 3 may be formed of a smooth press belt that is impermeable to air.

Suction zones 7, 9, 10, and 11 may be arranged to extend crosswise (lateral) to fibrous material web 1 and if necessary, may also extend over the entire width of fibrous material web 1.

During a transfer of strip 2 of fibrous material web 1, at least the transfer region 5 is provided with suction, and, during a subsequent transfer of the entire fibrous material web 1, at least most of a separating region 6, which follows transfer region 5, is supplied with suction.

As illustrated in FIG. 1A, a suction roll 12 includes a suction zone 7. Suction zone 7 may be located, during the transfer of strip 2 of fibrous material web 1, in transfer region 5 and may partially extend into separating region 6.

Figure 1B:
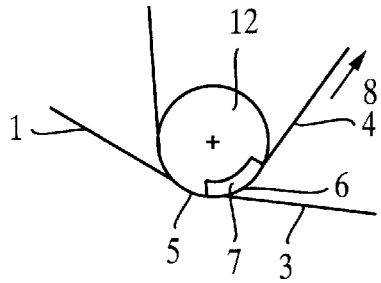

As illustrated in FIG. 1B, after the widening of strip 2, i.e., such that the entire width of fibrous material web 1 is being transferred, suction zone 7 may be rotated by rotating or pivoting suction chamber 7 within suction roll 12 to separating region 6. In this position, the transfer of the entire width of fibrous material web 1 can take place while a lower degree of re-wetting of fibrous material web 1 by releasing belt 3 occurs FIGS. 2A and 2B illustrate another embodiment of the present invention in which accepting belt 4 is guided directly over suction zone 7 and sealing of suction zone 7 may be provided at the edges via sliding surfaces 13.

Figure 2A:
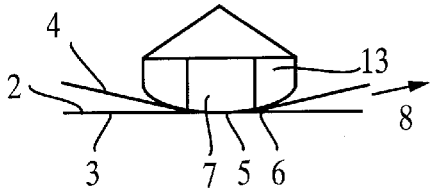
FIGS. 2A and 2B illustrate a pivotable suction device.
Figure 2B:
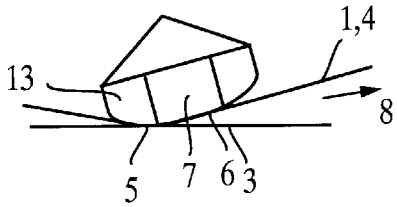

In this embodiment, the sliding surfaces 13 and suction zone 7 may be pivoted from a position shown in FIG. 2A, in which strip 2 is being transferred to accepting belt 2, to a position shown in FIG. 2B, in which the entire width of fibrous material web 1 is being transferred to accepting belt 4.

Figure 3A:
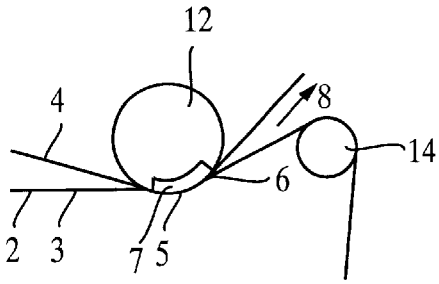
FIGS. 3A and 3B illustrate a transfer with a travel change of the releasing belt 3.
Figure 3B:
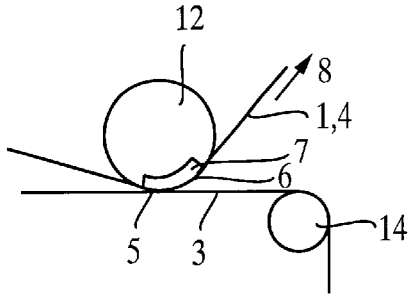
Figure 4:
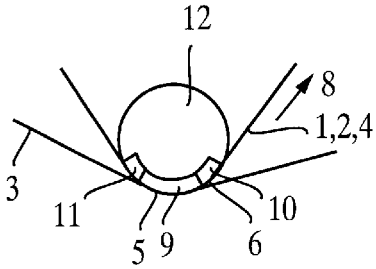
FIG. 4 illustrates a suction roll with a number of suction zones.

In FIGS. 3A and 3B, accepting belt 4 may be guided, as in FIGS. 1A and 1B, over a suction zone 7 of a suction roll 12. However, instead of suction zone 7 being pivotable, as shown in FIGS. 1A and 1B, releasing belt 3 may be guided over a positionally movable guide roll 14. In this manner, movement of guide roll 14 results in a shifting of transfer region 5. As shown in FIG. 3A, during the transfer of strip 2 in transfer region 5, both belts 3 and 4 are guided together with strip 2 in the region of suction zone 7.

When transferring the entire width of fibrous material web 1, as shown in FIG. 3B, transfer region 5 can then be shifted in a direction counter to web travel direction 8, In this manner, most of separating region 6 is provided with suction.

Further, at least one suction zone can be supplied with compressed air in the transfer region, such that, when the entire web is being transferred, the accepting belt is blown, preferably with air, on the surface of the accepting belt opposite the carrying surface.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although die present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for transferring a fibrous material web including a threading strip that increases in width crosswise to the material web from a thin strip to an entire width of the fibrous material web from a moist releasing belt to an accepting belt in a web producing machine that includes a transfer region and a separating region arranged in this order in a web travel direction, the process comprising:

guiding the accepting and releasing belts together at least in the transfer region;

separating the accepting belt from the releasing belt in the separating region; and suctioning a surface of the accepting belt opposite a fibrous web and strip carrying surface so that the strip and the fibrous material web are carried by the carrying surface, wherein, when the strip is being transferred, the suctioning occurs at in least the transfer region, and wherein, when an entire width of the fibrous material web is being transferred, the suctioning occurs at least primarily in the separating region.

2. The process according to claim 1, wherein, when the strip is being transferred, a suction zone is primarily located within the transfer region, and the process further comprises:

rotating the suction zone to be primarily located within the separating region.

3. The process according to claim 2, wherein the suction zone is located within a suction roll, and the suction zone is pivoted by rotating the suction roll.

4. The process in accordance with claim 2, wherein the suction zone is located in a suction device, and the suction zone is pivoted by rotating the suction device.

5. The process in accordance with claim 4, wherein sliding zones are arranged on opposite sides of the suction zone.

6. The process according to claim 1, wherein, when the strip is being transferred, a suction zone is primarily located within the transfer region, and the process further comprises:

changing a guide path of the web such that the suction zone is primarily located within the separating region.

7. The process in accordance with claim 1, wherein the transfer region and the separating region include a plurality of separately controllable suction zones successively arranged in a web travel direction.

8. The process in accordance with claim 7, wherein a first of the suction zones is arranged for operation only when the strip is being transferred, wherein a second of the suction zones is arranged for operation only when the entire web is being transferred, and wherein the second suction zone is arranged downstream of the first suction zone.

9. The process in accordance with claim 8, wherein a third suction zone is arranged upstream of the first suction zone to remove boundary layer air from the accepting belt before the transfer region.

10. The process according to claim 1, wherein when the releasing and accepting belts are first brought together in the transfer region, the process further comprising suctioning the accepting belt immediately before the transfer region.

11. The process according to claim 1, wherein, when the entire width of the fibrous material web is being transferred in the transfer region, the process further comprising blowing air on the surface opposite the carrying surface.

12. The process according to claim 1, wherein the accepting belt is composed of an air permeable belt.

13. The process according to claim 1, wherein the process first transfers the strip and subsequently transfers the entire width of the fibrous material web.

14. A process for threading a material web through a web producing machine, the material web including a threading strip that increases in width crosswise to the material web from a thin strip to an entire width of the material web, the process comprising:

guiding the strip of the material web on a releasing belt toward a transfer region;

guiding an accepting belt through the transfer region with the strip and the releasing belt;

suctioning the strip toward the accepting belt in the transfer region, whereby the strip is transferred onto the accepting belt;

separating the releasing belt from the accepting belt in a separating region located downstream of the transfer region in a web run direction;

guiding the strip until the entire width of the material web is transferred to the accepting belt; and suctioning the entire width of the material web toward the accepting belt at least primarily in the separating region.

15. The process according to claim 14, wherein when the entire width of the material web is transferred to the accepting belt, the process further comprising discontinuing suctioning in the transfer region.

16. The process according to claim 14, wherein when the entire width of the material web is transferred to the accepting belt, the process further comprising:

discontinuing suctioning in the transfer region; and blowing air through the accepting belt toward the entire width of the material web.

17. The process according to claim 14, wherein the releasing belt is deflected around a positionally movable deflection roll arranged downstream of the transfer region in the web run direction, the process further comprising:

positioning the deflection roll so that when the strip is being transferred to the accepting belt, both the accepting belt and the releasing belt are guided past a suction device; and moving the deflection roll when the entire width of the material web is being transferred to the accepting belt so that the accepting belt is guided over at least most of the suction device without the releasing belt.

18. The process according to claim 14, wherein a suction device composed of a plurality of suction element successively arranged in the web run direction is provided, the process further comprising;

guiding the accepting belt over a first suction element in the web run direction, whereby entrained air is sectioned;

guiding the accepting belt and the releasing belt over a second suction element in flie web run direction, which forms the transfer region; and guiding the accepting belt over at least most of a third suction element in the web run direction without the releasing belt, which forms the separating region.

19. The process according to claim 14 further comprising suctioning the accepting belt prior to the transfer region in the web run direction.

20. A process for threading a material web through a web producing machine, the material web including a threading strip that increases in width crosswise to the material web from a thin strip to an entire width of the material web, the process comprising:

guiding the strip of the material web on a releasing belt toward a transfer region;

guiding an accepting belt through the transfer region with the strip and the releasing belt;

suctioning the strip toward the accepting belt in the transfer region, whereby the strip is transferred onto the accepting belt;

separating the releasing belt from the accepting belt in a separating region located downstream of the transfer region in a web run direction;

guiding the strip until the entire width of the material web is transferred to the accepting belt; and suctioning the entire width of the material web toward the accepting belt in the separating region, wherein when the strip is being transferred to the accepting belt, no suctioning occurs in the separating region.

21. A process for threading a material web through a web producing machine, the material web including a threading strip that increases in width crosswise to the material web from a thin strip to an entire width of the material web, the process comprising:

guiding the strip of the material web on a releasing belt toward a transfer region;

guiding an accepting belt through the transfer region with the strip and the releasing belt;

suctioning the strip toward the accepting belt in the transfer region, whereby the strip is transferred onto the accepting belt;

separating the releasing belt from the accepting belt in a separating region located downstream of the transfer region in a web run direction;

guiding the strip until the entire width of the material web is transferred to the accepting belt; and suctioning the entire width of the material web toward the accepting belt in the separating region, wherein when the entire width of the material web is transferred to the accepting belt, the process further comprising pivoting a suction device from the transfer region to the separating region.

* * * * *